US007356874B2

(12) United States Patent
Skinner Macleod et al.

(10) Patent No.: US 7,356,874 B2
(45) Date of Patent: Apr. 15, 2008

(54) VACUUM CLEANER

(75) Inventors: Euan Skinner Macleod, Glasgow (GB); Ross Richardson, Auchterarder (GB); Christopher Richard Henderson, Glasgow (GB)

(73) Assignee: Hoover Limited, Mid Glamorgan (GB)

( * ) Notice: Subject to any disclaimer, the term of this patent is extended or adjusted under 35 U.S.C. 154(b) by 669 days.

(21) Appl. No.: 10/817,596

(22) Filed: Apr. 2, 2004

(65) Prior Publication Data

US 2004/0194247 A1 Oct. 7, 2004

(51) Int. Cl.
*A47L 9/00* (2006.01)

(52) U.S. Cl. ..... 15/328; 15/331; 15/334; 15/335

(58) Field of Classification Search ..... 15/328, 15/331, 334, 335
See application file for complete search history.

(56) References Cited

U.S. PATENT DOCUMENTS

| | | | | |
|---|---|---|---|---|
| 3,879,797 | A * | 4/1975 | Principe et al. | 15/334 |
| 4,571,772 | A | 2/1986 | Dyson | |
| 4,573,236 | A * | 3/1986 | Dyson | 15/333 |
| 5,331,715 | A * | 7/1994 | Johnson et al. | 15/332 |
| 5,477,586 | A * | 12/1995 | Jacobs et al. | 15/332 |
| 6,317,920 | B1 | 11/2001 | Brickner et al. | |
| 2002/0112315 | A1 | 8/2002 | Conrad | |
| 2003/0101535 | A1 | 6/2003 | Gammack et al. | |
| 2004/0060144 | A1 * | 4/2004 | Bowden et al. | 15/334 |

FOREIGN PATENT DOCUMENTS

| | | | |
|---|---|---|---|
| DE | 19915881 | * | 10/2000 |
| GB | 1 394 497 | | 5/1975 |
| JP | 06178744 A | * | 6/1994 |
| JP | 2002-233483 | * | 8/2002 |

OTHER PUBLICATIONS

European Search Report—Application No. EP 04 25 1833 in Munich on Jul. 15, 2005.

* cited by examiner

*Primary Examiner*—David A Redding
(74) *Attorney, Agent, or Firm*—Cook, Alex, McFarron, Manzo, Cummings & Mehler, Ltd.

(57) ABSTRACT

An upright vacuum cleaner comprises a body including a dust separator, a floor engaging head having a first dirty air inlet on its underside, a handle detachably mounted in a socket on the body and having a second dirty air inlet at its lower end, a flexible hose extending between the center of the handle and the body, a valve, and a valve actuator disposed in the socket for configuring the valve to connect the dust separator to the first or second inlets respectively when the handle is engaged and disengaged from the body. When engaged to the body, the upper end of handle is used to propel and guide the cleaner while suction is applied to the first dirty air inlet in the floor engaging head. Once detached, the handle is immediately ready for use as a tool for above-floor cleaning without the user having to manually divert the suction or fit cleaning tools.

14 Claims, 3 Drawing Sheets

VACUUM CLEANER

BACKGROUND OF THE INVENTION

1. Field of the Invention

This invention relates to a vacuum cleaner.

2. Related Background Art

Known vacuum cleaners are either of the so-called upright type or the so-called cylinder type. Upright vacuum cleaners comprise an upright portion pivotally connected at its lower end to a wheeled floor-engaging portion for partial rotation forwardly and rearwardly about a transverse axis. The upright portion encloses a motor/fan unit which draws air into a dust separation device through an inlet in the floor-engaging portion of the cleaner. A handle is provided at the upper end of the upright portion for pushing the cleaner to and fro. A motor-driven rotating agitator brush mounted across the inlet in the floor-engaging portion beats and sweeps the floor in the region of the airflow into the cleaner.

Cylinder vacuum cleaners comprise a body which encloses a motor/fan unit which draws air into a dust separation device through an elongate flexible hose. A plurality of tools are provided for fitting to the end of the hose.

Upright vacuum cleaners are better at cleaning carpets than cylinder vacuum cleaners because of the action of the rotating agitator brush. However, cylinder vacuum cleaners are better suited for above-floor cleaning and for cleaning in places where an upright cleaner cannot be used.

In order to provide a cleaner having the advantages of both upright and cylinder cleaners, it is known to provide an upright cleaner having an elongate flexible hose which can either be connected to the floor-engaging portion of the cleaner for conventional floor cleaning, or connected to an extension tube and/or cleaning tools for above-floor cleaning.

A disadvantage of this arrangement is that during conventional floor cleaning, the airflow thorough the cleaner is partially restricted by the elongate flexible hose, which is coiled for storage on the back of the cleaner. The coiled length of hose is also susceptible to blockage.

In order to overcome the above-mentioned problem, vacuum cleaners of the upright type are known which comprise a hose and a valve which can be actuated such that the suction is either applied to the hose for above-floor cleaning or to the floor-engaging portion of the cleaner for conventional floor cleaning.

European Patent No. 0 037 674 discloses an upright vacuum cleaner of the above-mentioned type comprising an elongate rigid tube, which is mounted vertically to the rear of the cleaner body and which forms a handle for propelling and guiding the cleaner during conventional floor cleaning. In this configuration, the elongate rigid tube is enclosed within an elongate flexible suction hose which is retracted to its minimum length, and which is connected at its lower extremity to one of the inlet ports of a two-way valve, the outlet port of which is connected to the inlet of a cyclonic separator. In order to carry out above-floor cleaning, the rigid suction tube is withdrawn from the retracted suction hose, the tube and hose having end fittings which effect an airtight connection between the two conduits when the tube is withdrawn from the hose to its fullest extent. The action of withdrawing the rigid tube from its conventional floor cleaning position actuates the two-way valve, to divert the suction airstream from the floor-engaging portion of the cleaner to the hose.

A disadvantage of this arrangement is that the elongate rigid suction tube is permanently connected to the hose and makes it difficult to clean in confined spaces. The way in which the rigid tube has to be inside the retracted flexible hose makes the cleaner inconvenient to use for above-floor cleaning.

We have now devised a vacuum cleaner which can be used for both floor and above-floor cleaning and which alleviates the above-mentioned problems.

SUMMARY OF THE INVENTION

In accordance with this invention, there is provided a vacuum cleaner comprising:

a floor-engaging portion having a first air inlet on the underside thereof;

an upright portion pivotally connected at its lower end to said floor-engaging portion;

a detachable handle upstanding from the upper end of said upright portion and having a first end and a second end;

a rigid tubular duct extending along the handle between a second air inlet at said first end thereof and an outlet disposed intermediate opposite ends of said handle;

an elongate flexible hose having a first end and a second end, the first end of the hose being connected to said outlet on said handle; and a valve having a first inlet port fluidly connected to said first air inlet, a second inlet port fluidly connected to the second end of said elongate flexible hose, an outlet port connected to a dust separation device and means for selectively connecting said valve outlet port to either said first or said second valve inlet ports.

In use, to use the cleaner for floor cleaning, the valve is configured to apply suction to the first air inlet in the floor-engaging portion. The handle is then used to propel and guide the cleaner over the surface being cleaned. To use the cleaner for above-floor cleaning, the handle is simply detached and the valve configured to apply suction to the second air inlet at the first end of the handle via the elongate flexible hose.

Preferably, one end of the handle is received in a socket in the upper end of said upright portion of the cleaner.

Preferably, the first end of the handle is received in the socket in the upper end of said upright portion of the cleaner. In this manner, the second air inlet is concealed from view.

Preferably, the second end of the handle is closed and is preferably shaped to provide a hand grip which can be grasped by the user.

Preferably, the valve comprises an actuator disposed in said socket, the actuator being arranged to configure the valve to connect said second air inlet to said dust separation device when the handle is removed from said socket and to connect said first air inlet to said dust separation device when the handle is fully inserted into said socket.

Preferably, the handle is retained in the socket against a resilient bias by a catch. When the catch is released, the handle is biassed out of the socket to a position where it is conveniently offered to the user for above-floor cleaning. Simultaneously, the valve is actuated to divert the suction from the first air inlet on the underside of the floor-engaging portion to the second air inlet on the handle.

Another disadvantage of known vacuum cleaners which can be used for both floor and above-floor cleaning is that each time the cleaner is required for above-floor cleaning, the user firstly has to locate and then connect a tool to the end of the hose before cleaning can commence. Thus, the cross-sectional area of the rigid tubular duct extending along the handle preferably increases substantially from said second air inlet at said first end of the handle towards said outlet disposed intermediate opposite ends of said handle, the lower end of the handle comprising an elongate outer portion having a substantially uniform cross-sectional area, said socket being arranged to receive said elongate outer portion of the lower end of the handle. The elongate outer portion of the lower end of the handle thus acts to form a narrow above-floor cleaning tool, which is already connected in-situ ready for use, thereby avoiding the need to connect a tool before cleaning can commence.

Preferably, the cross-sectional area of the elongate outer portion of the lower end of the handle at said second air inlet is 40%-60% less than the cross-sectional area of the rigid tubular duct adjacent said outlet of the handle.

BRIEF DESCRIPTION OF THE DRAWINGS

An embodiment of this invention will now be described by way of example only and with reference to the accompanying drawings, in which.

DETAILED DESCRIPTION OF THE PREFERRED EMBODIMENT

Figure 1:
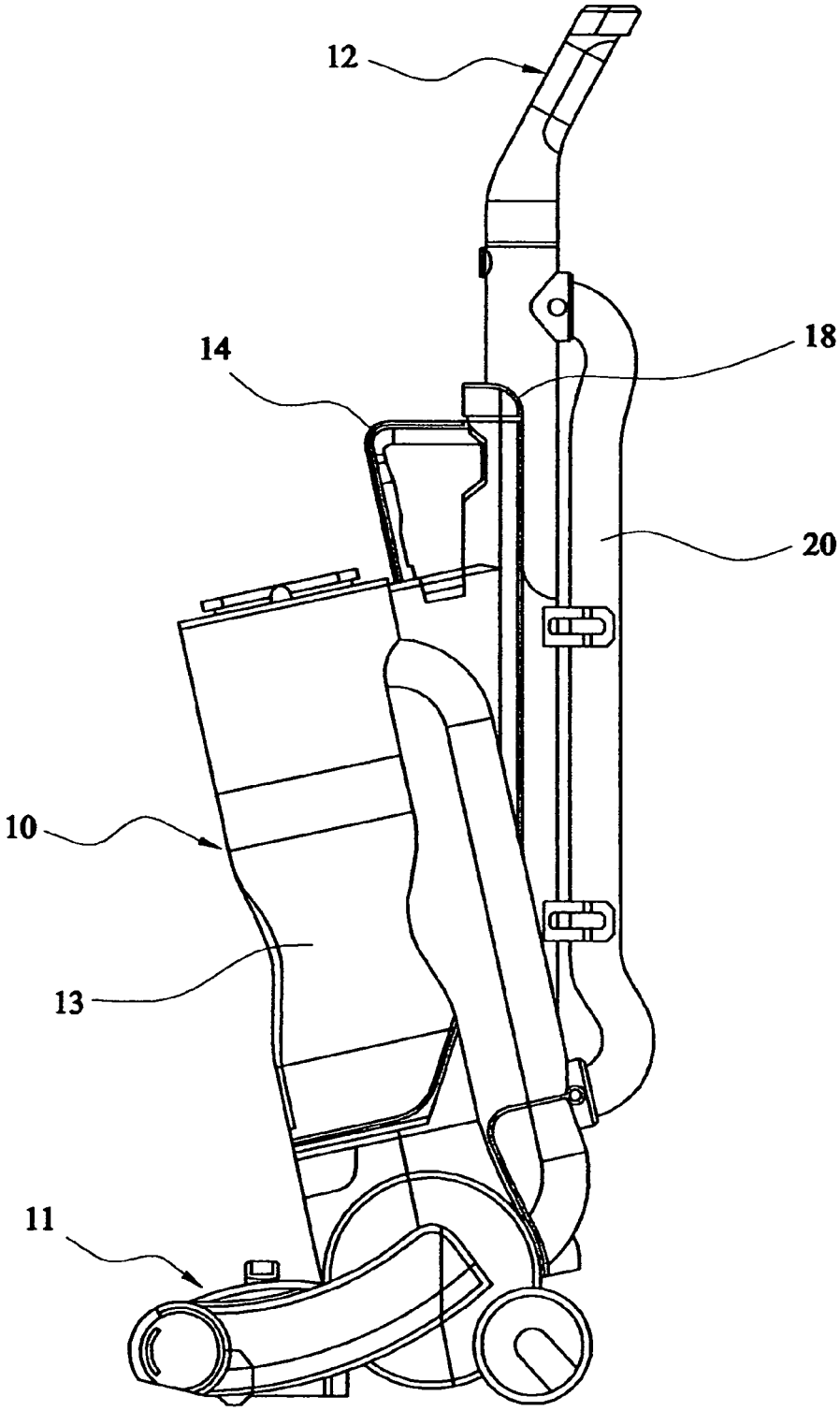
FIG. 1 is a side view of an upright vacuum cleaner in accordance with this invention, configured for floor cleaning.

Referring to FIG. 1 of the drawings, there is shown an upright vacuum cleaner comprising a upright portion 10 pivotally connected at its lower end to a floor-engaging portion 11 for partial rotation forwardly and rearwardly about a transverse axis. The upright portion 10 encloses a motor/fan unit and comprises a detachable handle 12 at its upper end for propelling and guiding the cleaner over the surface being cleaned. The floor-engaging portion 11 incorporates a suction inlet and a conventional motor-driven rotating brush mounted across the inlet.

A cylindrical separation unit 13 for separating dirt and dust from the airflow is mounted to the front of the upright portion 10 of the cleaner. A further handle 14 for carrying the cleaner is provided on top of the upright portion 10 of the cleaner.

Figure 2:
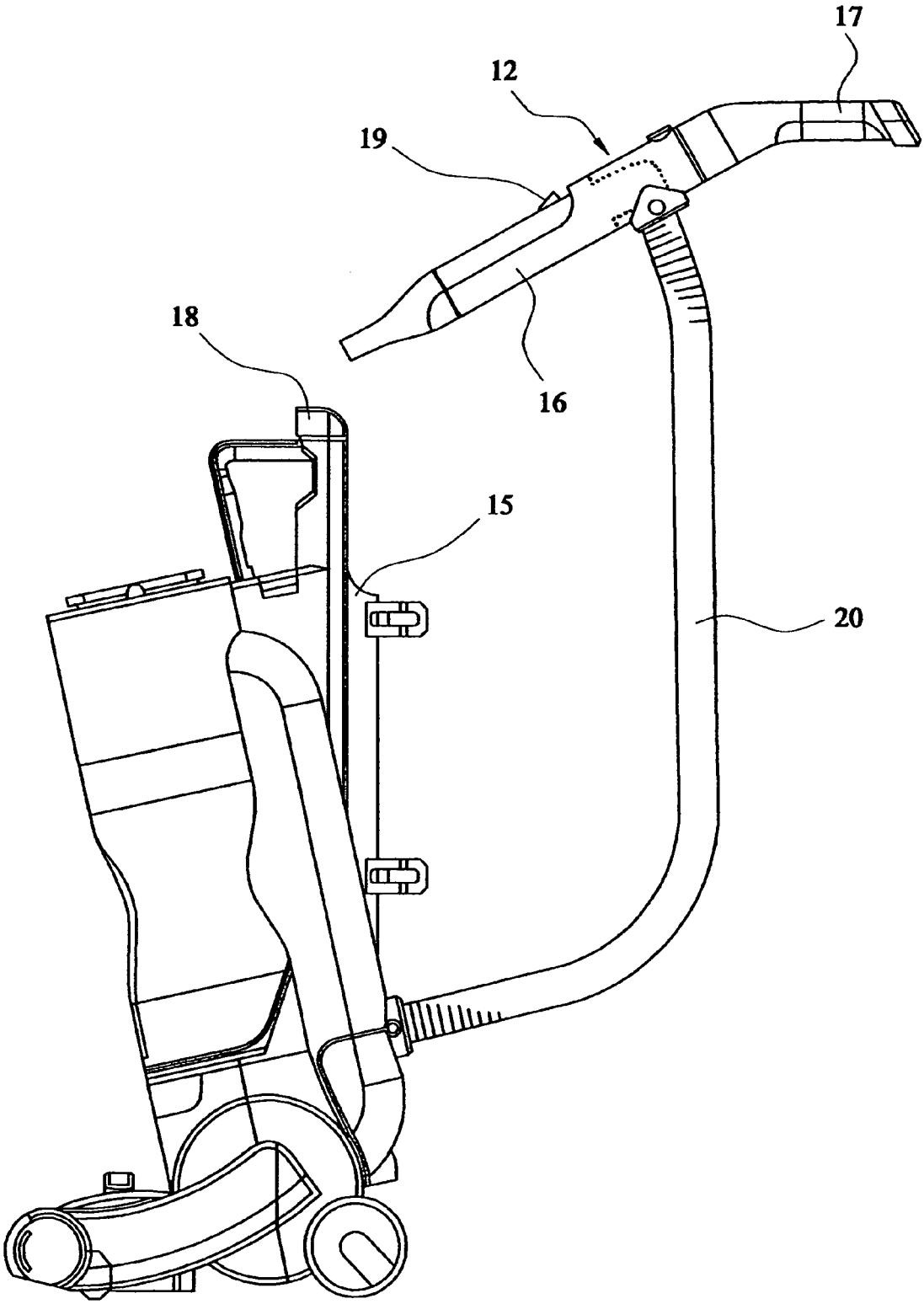
FIG. 2 is a side view of an upright vacuum cleaner in accordance with this invention, configured for above-floor cleaning.

Referring to FIG. 2 of the drawings, the handle 12 for guiding and propelling the cleaner during floor cleaning comprises a tubular lower portion 16 and an upper portion 17 in the form of a hand grip. The lower portion 16 is detachably mounted in a vertical socket 15 in the rear of the upright portion 10 of the cleaner. The upper portion of the wall of the socket 15 is C-shaped in section and is provided with a catch 18 which engages a barb 19 on the lower portion 16 of the handle 12 to retain the latter in the socket 15.

An elongate flexible hose 20 extends from the upright portion 10 of the cleaner and is connected at its outer end to a port provided in the side wall of the tubular lower portion 16 of the handle 12, at a point intermediate opposite ends of the handle 12. The diameter of the tubular lower portion 16 of the handle 12 reduces over a region at the lower end to provide a so-called crevice tool. The crevice tool may be formed integrally with the tubular body portion of the handle 12. Alternatively, it may be formed separately and attached to the tubular body portion of the handle 12 in such a manner that it cannot readily be detached by the user.

Figure 3:
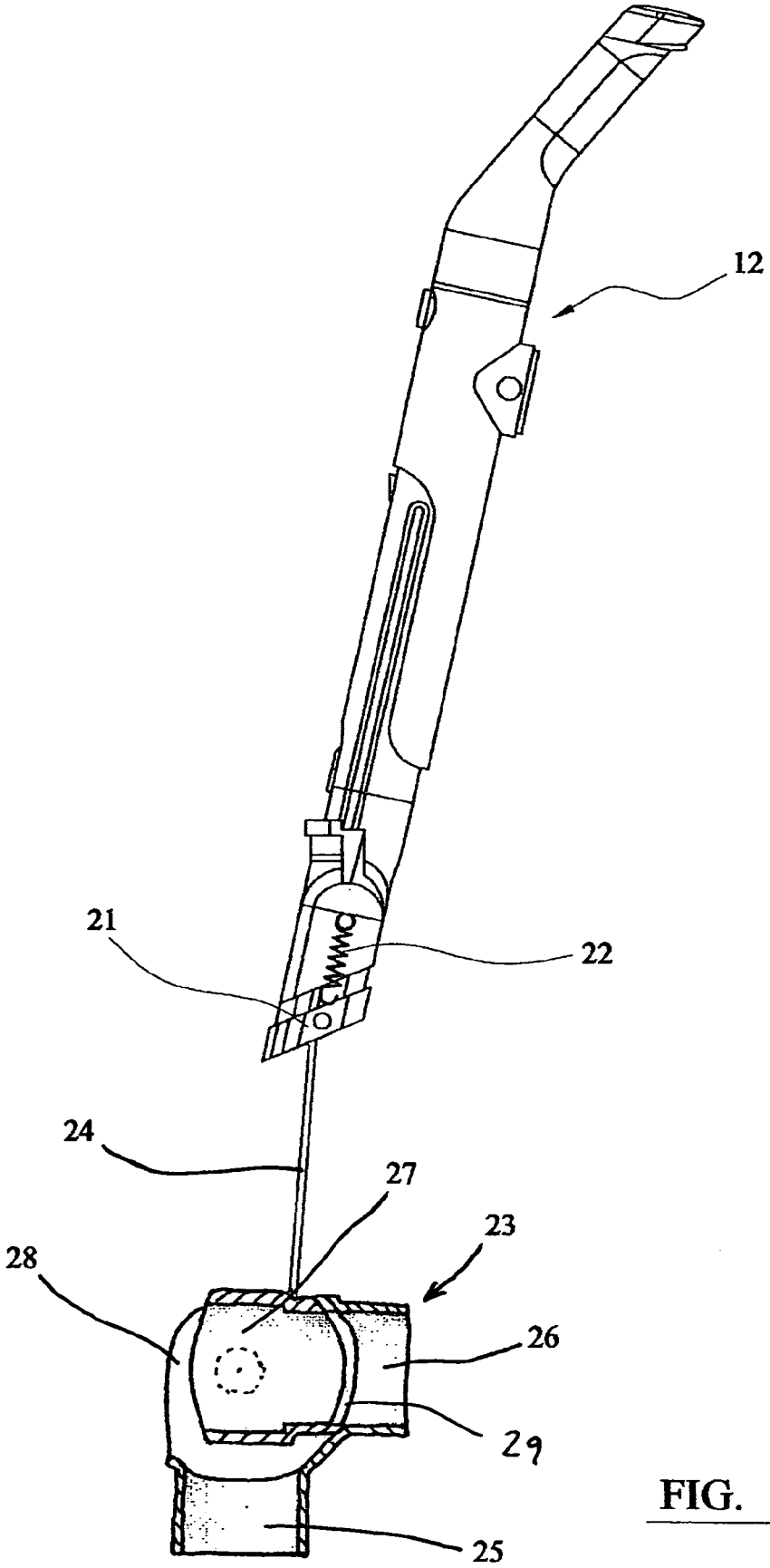
FIG. 3 is a schematic diagram to illustrate the principle of operation of a valve mechanism of the cleaner of FIG. 1.

Referring to FIG. 3 of the drawings, when the cleaner is being used for conventional floor cleaning and the handle 12 is fitted in the socket 15, the lower end of the handle 12 abuts a member 21, which is disposed at the bottom of the socket 15 and which is biassed upwardly by springs eg 22 mounted on respective lateral sides of the socket. The underside of the member 21 is connected to a valve 23 by a linkage 24. The valve 23 comprises a body 28 having a first inlet duct 25 connected to the suction inlet in the floor-engaging portion 11 of the cleaner and a second inlet duct 26 connected to the proximal end of the elongate flexible hose 20.

An outlet duct 27 is rotatably mounted to the body 28 and comprises one end provided with a seal 29 for selective alignment with one of said inlet ducts 25, 26. The opposite end of the of the outlet duct 27 of the valve 23 is connected via a flexible hose (not shown) to the motor/fan unit via the separation unit 13, which separates dirt and dust from the airflow.

The rotary outlet duct 27 is connected to the linkage 24, such that the outlet duct 27 of the valve is connected to the inlet duct 25 when the member 21 is pushed down by the lower end of the handle 12 as the latter is fitted to the cleaner for conventional floor cleaning. The handle 12 is retained in the socket 15 against the resilient bias by the catch 18 on the wall of the socket, which engages the barb 19 on the handle 12.

In order to use the cleaner for above-floor cleaning, the user merely has to release the catch 18, which allows the handle 12 to move a small distance upwardly out of the socket 15 under the applied bias to the member 21. This upward movement of the member 21 actuates the linkage 24, which rotates the outlet duct 27 to a position where it is connected to the inlet duct 26 to which the hose 20 is connected.

Once released, the handle 12 is immediately ready for use as a tool for above-floor cleaning without the user having to manually divert the suction or fit cleaning tools. The hose 20 is of the long-stretch type, which is able to extend to in excess of six times its retracted length. The arrangement of the cleaner is ideally suited to stair cleaning, since the body of the cleaner can be left at the top or bottom of the stairs whilst the tool is used to clean the stairs.

The cleaner is easily reverted to floor cleaning by replacing the handle 12 in the socket 15, until the catch 18 on the wall of the socket 15 engages the barb 19 on the handle 12, whereupon the suction is diverted from the hose 20 to the to the suction inlet in the floor-engaging portion 11 of the cleaner.

A vacuum cleaner in accordance with this invention is uncomplicated in construction yet can be simply and conveniently converted between floor and above-floor cleaning use.

Reference is made to our co-pending US applications claiming priority from United Kingdom Patent Application Nos. 0307928.2 and 0307929.0 of 5 Apr. 2003, the disclosures of which are incorporated herein by reference.

While the preferred embodiment of the invention has been shown and described, it will be understood by those skilled in the art that changes or modifications may be made thereto without departing from the true spirit and scope of the invention.

We claim:

1. A vacuum cleaner comprising:

a floor-engaging portion having a first air inlet on the underside thereof;

an upright portion pivotally connected at its lower end to said floor-engaging portion, said upright portion having a socket in its upper end;

a detachable handle upstanding from the upper end of said upright portion and having a first end and a second end, one of said handle ends being received in said socket;

a rigid tubular duct extending along the handle between a second air inlet at said first end thereof and an outlet disposed intermediate opposite ends of said handle;

an elongate flexible hose having a first end and a second end, the first end of the hose being connected to said outlet on said handle;

a valve having a first inlet port fluidly connected to said first air inlet, a second inlet port fluidly connected to the second end of said elongate flexible hose, an outlet port connected to a dust separation device and means for selectively connecting said valve outlet port to either said first or said second valve inlet ports; and, said valve comprising an actuator disposed in said socket, the actuator being arranged to configure the valve to connect said second air inlet to said dust separation device when the handle is removed from said socket and to connect said first air inlet to said dust separation device when the handle is fully inserted into said socket.

2. A vacuum cleaner as claimed in claim 1, in which said first end of the handle is received in said socket in the upper end of said upright portion of the cleaner.

3. A vacuum cleaner as claimed in claim 2, in which the second end of the handle is closed.

4. A vacuum cleaner as claimed in claim 3, in which the second end of the handle is shaped to provide a hand grip which can be grasped by the user.

5. A vacuum cleaner as claimed in claim 1, in which the handle is retained in the socket against a resilient bias by a catch.

6. A vacuum cleaner as claimed in claim 1, in which the cross-sectional area of the rigid tubular duct extending along the handle preferably increases substantially from said second air inlet at said first end of the handle towards said outlet disposed intermediate opposite ends of said handle, the outer portion of the first end the handle comprising an elongate portion having a substantially uniform cross-sectional area, said socket being arranged to receive said elongate outer portion of the lower end of the handle.

7. A vacuum cleaner as claimed in claims 6, in which the cross-sectional area of the elongate outer portion of the lower end of the handle at said second air inlet is 40%-60% less than the cross-sectional area of the rigid tubular duct adjacent said outlet of the handle.

8. A vacuum cleaner comprising:

a floor-engaging portion having a first air inlet on the underside thereof;

an upright portion pivotally connected at its lower end to said floor-engaging portion, said upright portion having a socket in its upper end;

a detachable handle upstanding from the upper end of said upright portion and having a first end and a second end, one of said handle ends being received in said socket and the handle is retained in the socket against a resilient bias by a catch;

a rigid tubular duct extending along the handle between a second air inlet at said first end thereof and an outlet disposed intermediate opposite ends of said handle;

an elongate flexible hose having a first end and a second end, the first end of the hose being connected to said outlet on said handle; and a valve having a first inlet port fluidly connected to said first air inlet, a second inlet port fluidly connected to the second end of said elongate flexible hose, an outlet port connected to a dust separation device and means for selectively connecting said valve outlet port to either said first or said second valve inlet ports.

9. A vacuum cleaner as claimed in claim 8, in which said first end of the handle is received in said socket in the upper end of said upright portion of the cleaner.

10. A vacuum cleaner as claimed in claim 9, in which the second end of the handle is closed.

11. A vacuum cleaner as claimed in claim 10, in which the second end of the handle is shaped to provide a hand grip which can be grasped by the user.

12. A vacuum cleaner as claimed in claim 8, in which the valve comprises an actuator disposed in said socket, the actuator being arranged to configure the valve to connect said second air inlet to said dust separation device when the handle is removed from said socket and to connect said first air inlet to said dust separation device when the handle is fully inserted into said socket.

13. A vacuum cleaner as claimed in claim 8, in which the cross-sectional area of the rigid tubular duct extending along the handle preferably increases substantially from said second air inlet at said first end of the handle towards said outlet disposed intermediate opposite ends of said handle, the outer portion of the first end the handle comprising an elongate portion having a substantially uniform cross-sectional area, said socket being arranged to receive said elongate outer portion of the lower end of the handle.

14. A vacuum cleaner as claimed in claims 13, in which the cross-sectional area of the elongate outer portion of the lower end of the handle at said second air inlet is 40%-60% less than the cross-sectional area of the rigid tubular duct adjacent said outlet of the handle.

* * * * *